US012570452B2

(12) United States Patent
Sharma et al.

(10) Patent No.: US 12,570,452 B2
(45) Date of Patent: Mar. 10, 2026

(54) EASY-OPEN POUCH WITH SCORE LINE AND RETENTION OF TORN SECTION

(71) Applicant: GP&C Operations, LLC, Gardner, MA (US)

(72) Inventors: Neeraj Sharma, Crystal Lake, IL (US); Michael S. Dennis, Crystal Lake, IL (US); James Michael Cormier, II, Baldwinville, MA (US)

(73) Assignee: GP&C OPERATIONS, LLC, Gardner, MA (US)

( * ) Notice: Subject to any disclaimer, the term of this patent is extended or adjusted under 35 U.S.C. 154(b) by 20 days.

(21) Appl. No.: 18/498,550

(22) Filed: Oct. 31, 2023

(65) Prior Publication Data

US 2024/0150103 A1 May 9, 2024

Related U.S. Application Data

(60) Provisional application No. 63/382,547, filed on Nov. 7, 2022.

(51) Int. Cl.

| | |
|---|---|
| ***B65D 75/58*** | (2006.01) |
| ***B65B 5/02*** | (2006.01) |
| ***B65B 7/02*** | (2006.01) |
| ***B65B 9/08*** | (2012.01) |
| ***B65B 43/06*** | (2006.01) |
| ***B65B 51/00*** | (2006.01) |
| ***B65B 61/02*** | (2006.01) |

(Continued)

(52) U.S. Cl.

CPC ..... *B65D 75/5805* (2013.01); *B65B 5/022* (2013.01); *B65B 7/02* (2013.01); *B65B 9/08* (2013.01); *B65B 43/06* (2013.01); *B65B 51/00* (2013.01); *B65B 61/02* (2013.01); *B65B 61/04* (2013.01); *B65D 65/40* (2013.01); *B65D 65/466* (2013.01); *B65D 75/30* (2013.01); *B65D 2565/385* (2013.01); *B65D 2565/387* (2013.01)

(58) Field of Classification Search

CPC ..... B65D 65/40; B65D 65/466; B65D 75/30; B65D 75/58; B65D 75/5805; B65D 2565/385; B65D 2565/387

USPC ..... 206/484–484.2; 383/37, 200–201, 383/207–209

See application file for complete search history.

(56) References Cited

U.S. PATENT DOCUMENTS 7,908,826 B2 * 3/2011 Reaves ..... B65B 9/213 53/469

8,740,458 B2 * 6/2014 Edwards ..... B65B 51/303 383/207

(Continued)

FOREIGN PATENT DOCUMENTS

WO WO-2021144182 A1 * 7/2021 ..... B65D 75/5805

OTHER PUBLICATIONS

Scored Tear-open Pouch (Year: 2021).*

*Primary Examiner* — Bryon P Gehman

(74) *Attorney, Agent, or Firm* — Myers Bigel, P.A.

(57) ABSTRACT

A sealed package includes first and second opposed plies, each with first and second edges, wherein the first edges of the first and second plies have overlying sections that form a first seal, and wherein the second edges of the first and second plies have overlying sections that form a second seal; the first and second plies include polymeric film. A score line is present adjacent the second seal, the score line only partially penetrating the first ply and extending less than a full width of the first ply.

5 Claims, 8 Drawing Sheets

(51) Int. Cl.

| | |
|---|---|
| ***B65B 61/04*** | (2006.01) |
| ***B65D 65/40*** | (2006.01) |
| ***B65D 65/46*** | (2006.01) |
| ***B65D 75/30*** | (2006.01) |

(56) References Cited

U.S. PATENT DOCUMENTS

| | | | | |
|---|---|---|---|---|
| 9,120,609 | B2 * | 9/2015 | De Soto-Burt | A61F 13/55175 |
| 9,302,835 | B2 * | 4/2016 | Laske | B65D 75/5811 |
| 10,071,833 | B2 * | 9/2018 | Haedt | B65D 75/5805 |
| 10,315,823 | B2 * | 6/2019 | Murdick | B65D 81/3453 |
| 10,343,835 | B2 * | 7/2019 | Klipstine | B65D 81/343 |
| 10,427,851 | B2 * | 10/2019 | Steele | B65D 75/5816 |
| 11,390,441 | B2 * | 7/2022 | Yajima | B65D 75/322 |
| 11,548,720 | B2 * | 1/2023 | Joseph | B65D 65/38 |

* cited by examiner

EASY-OPEN POUCH WITH SCORE LINE AND RETENTION OF TORN SECTION

RELATED APPLICATION

The present application claims priority from and the benefit of U.S. Provisional Patent Application No. 63/382,547, filed Nov. 7, 2022, the disclosure of which is hereby incorporated herein by reference in full.

FIELD OF THE INVENTION

The present invention is directed generally to packaging and more specifically to plastic film-based packaging.

BACKGROUND OF THE INVENTION

Many products are packaged using such films that are converted into a finished bag/pouch using form, fill and seal machines. Such machines receive a thin web of material, fold it into an open-ended pouch, fill the pouch with the desired contents, and seal the open end of the pouch to capture the contents within the pouch. Form, fill and seal machines may be configured to have either vertical or horizontal travel of the web. Exemplary vertical and horizontal form, fill and seal packaging machines are illustrated at, for example, at Vertical Form Fill Seal Machine [DIN00] | Download Scientific Diagram (researchgate.net) and (researchgate.net) https://www.youtube.com/watch?v=XP5TYyC5oL0 (vertical) and Horizontal Form Fill Seal Machine [DIN00] | Download Scientific Diagram (researchgate.net) and https://www.youtube.com/watch?v=00ZO41_FZ-E (horizontal).

Many packagers are interested in switching to recyclable films for environmental friendliness and sustainability. One such recyclable film of interest is polyethylene. However, polyethylene films are typically discouraged from packaging of this sort because opening the pouch can be difficult. Due to their molecular structure, under load polyethylene films tend to stretch rather than tear. One proposed solution involves tearing from a starter cut at the top of the pouch (i.e., at the upper edge of the sealed end). Unfortunately, such tearing can easily progress in an uncontrolled manner (both in the extent and the direction of the tear), with over-tearing (and subsequent loss of the contents) potentially occurring. As such, there is a need for an easy opening feature for pouches (particularly those made of polyethylene) used in packaging.

SUMMARY OF THE INVENTION

As a first aspect, embodiments of the invention are directed to a sealed package. The sealed package comprises first and second opposed plies, each with first and second edges, wherein the first edges of the first and second plies have overlying sections that form a first seal, and wherein the second edges of the first and second plies have overlying sections that form a second seal. The first and second plies comprise polymeric film. A score line is present adjacent the second seal, the score line only partially penetrating the first ply.

As a second aspect, embodiments of the invention are directed to a method of forming a sealed package comprising:

(a) providing a roll of polymeric film, wherein the polymeric film comprises a plurality of regularly spaced score lines extending from a side edge thereof, each of the score lines only partially penetrating the film; and (b) with a form, fill and seal machine, forming a sealed package from the polymeric film, the sealed package comprising first and second opposed plies, each with first and second edges, wherein the first edges of the first and second plies have overlying sections that form a first seal, and wherein the second edges of the first and second plies have overlying sections that form a second seal, wherein the sealed package has one of the plurality of score lines adjacent the second seal.

As a third aspect, embodiments of the invention are directed to a sealed package. The package comprises first and second opposed plies, each with first and second edges, wherein the first edges of the first and second plies have overlying sections that form a first seal, and wherein the second edges of the first and second plies have overlying sections that form a second seal. The first and second plies comprise polymeric film. A score line is present adjacent the second seal, the score line only partially penetrating the first ply and extending less than a full width of the first ply.

DETAILED DESCRIPTION

Figure 1:
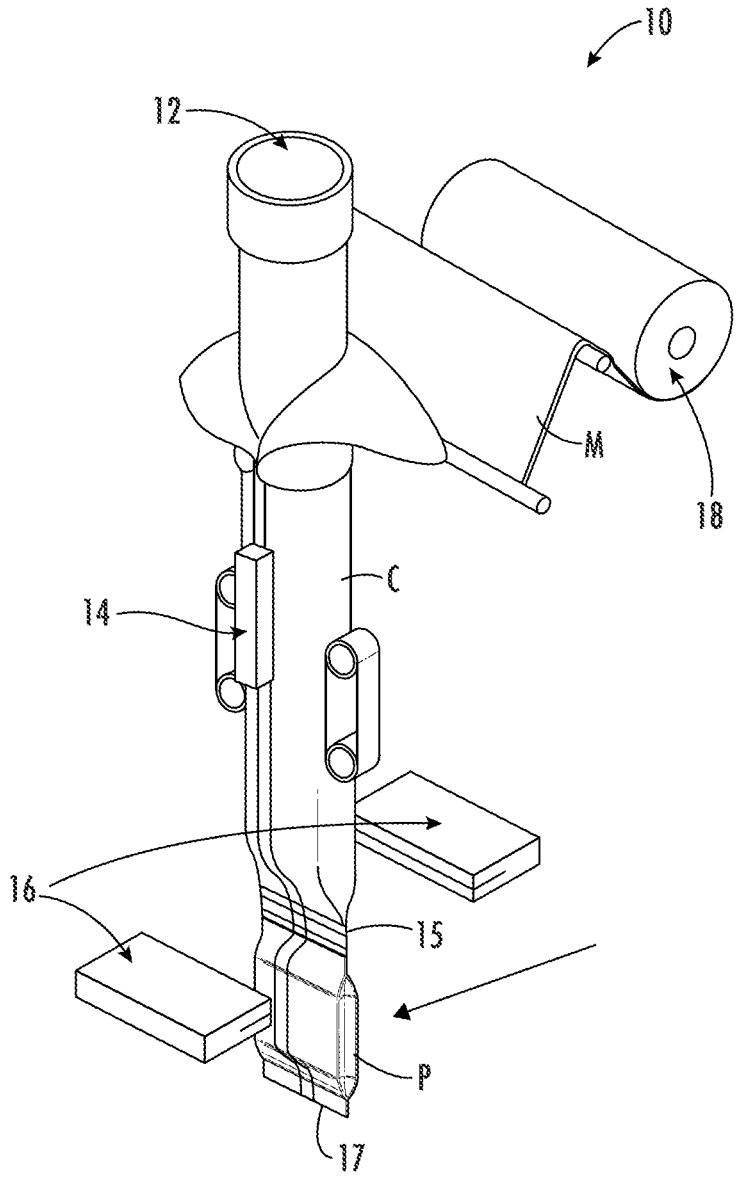
FIG. 1 is a schematic diagram of a conventional vertical form, fill and seal machine.

The present invention is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

It will also be understood that, as used herein, the terms "example," "exemplary," and derivatives thereof are intended to refer to non-limiting examples and/or variants embodiments discussed herein, and are not intended to indicate preference for one or more embodiments discussed herein compared to one or more other embodiments.

Referring now to the figures, FIG. 1 illustrates an exemplary vertical form, fill and seal machine, designated broadly at 10. The machine 10 includes a hollow forming tube 12, a vertical sealing bar 14, and two sealing/cutting jaws 16. As can be understood from FIG. 1, a web of material M is fed from a roll 18 and wrapped around the forming tube 12. The sealing bar 14 seals the side edges of the web to form the material into an elongate cylinder C, and the sealing jaws come together to form a seal on the lower edge of the cylinder C. Product is fed into the forming tube 12, which conveys the product to the cylinder C. Once filled, the lower sealed end of the cylinder C lowers, and the jaws 16 close again to seal the upper end of the cylinder C to form a pouch P with an upper seal 17. The jaws 16 also cut the pouch P at the seal S to separate it from the lower end of cylinder C; doing so separates the seal S into the upper seal for the full pouch P that was just formed and the lower seal of the next pouch P. The result is a pouch P that encloses the product between two opposed plies, with seals 15, 17 at its upper and lower ends.

Figure 2:
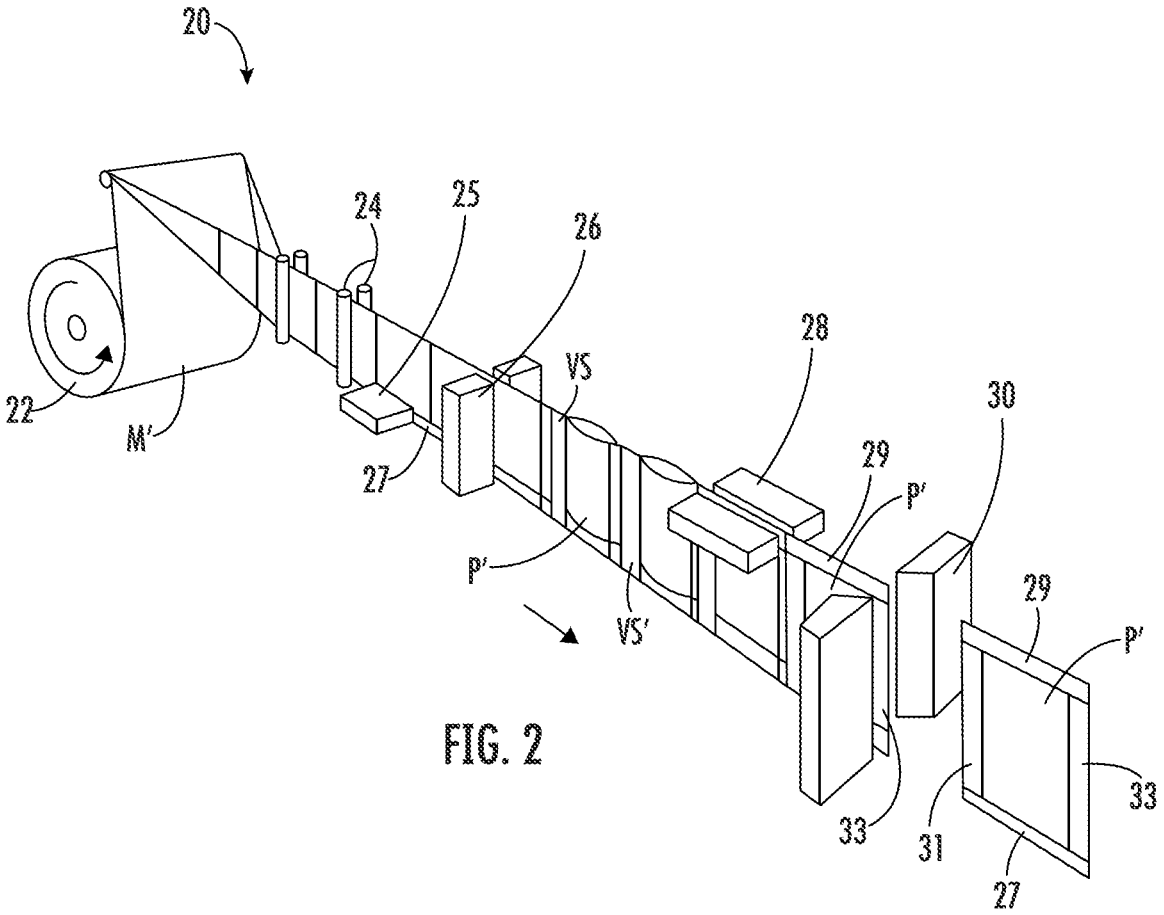
FIG. 2 is a schematic diagram of a conventional horizontal form, fill and seal machine.

FIG. 2 illustrates an exemplary horizontal form, fill and seal machine designated broadly at 20. In the machine 20, a web of material M' is fed from a roll 22 through guides 24 that fold the web in half lengthwise into two plies. Lower sealing jaws 25 form a seal 27 on the bottom edge of the folded web. Cross sealing jaws 26 then engage the folded web to form a vertical sealed seam VS, which, combined with the portion of the web immediately downstream from the seam VS that includes the seam VS' that was formed immediately prior to the seam VS, define an open-ended pouch P'. The pouch P' is filled with material X, then sealed at the upper end (designated 29) by closing jaws 28. The closed pouch P' is then conveyed to a separator 30, which slices the seam VS to form both the trailing seam 31 of the downstream pouch P' and the leading seam 33 of the upstream pouch P'. Thus, in this instance the result is a pouch P' that encloses the product between two opposed plies, but the pouch P' has seals 27, 31, 33 and 29 on all four sides.

Conventionally, when pouches are formed of polyethylene film by either of these techniques, both of the finished pouches P, P' produced by the machines 10, 20 suffer from the shortcoming described above: namely, that the pouches P, P' are opened from their upper ends, where there is a tear in the seal at the upper end to help initiate tearing, and the extent and direction of tearing are generally unpredictable and may render the package unsuitable for storage immediately after opening.

Figure 3:
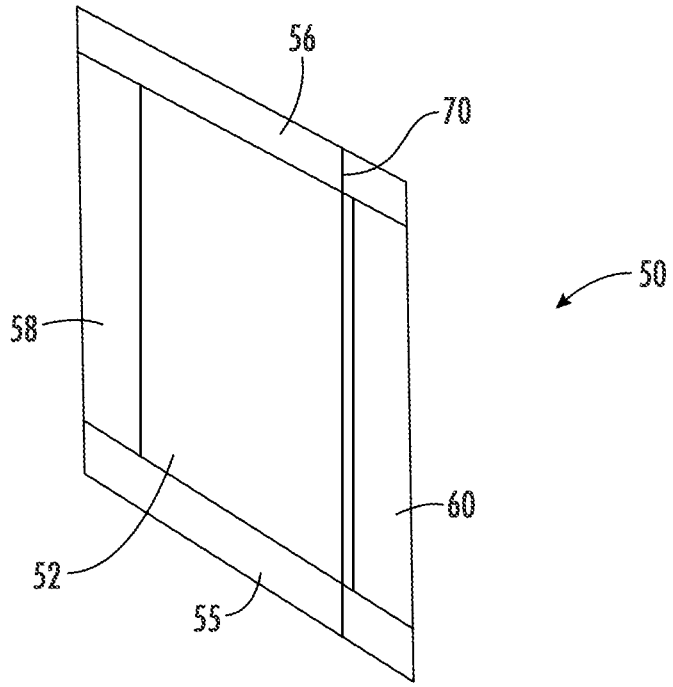
FIG. 3 is a schematic perspective view of an easy-open polyethylene pouch according to embodiments of the invention.
Figure 4:
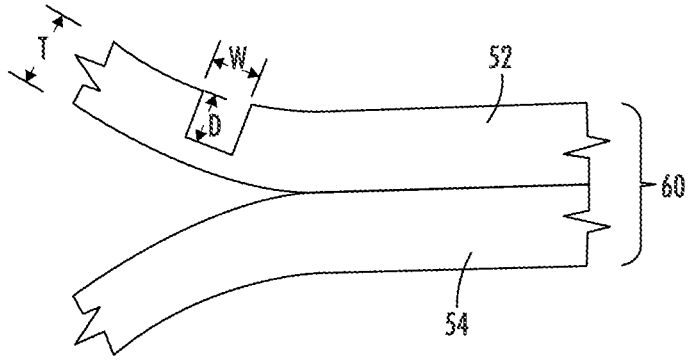
FIG. 4 is a partial side-section view of the pouch of FIG. 3 showing the score line.

A technique that can help address these shortcomings is illustrated in FIGS. 3-6. A pouch 50 illustrated therein includes two opposed plies 52, 54 that are sealed (in this instance, in the manner discussed in connection with the horizontal form, fill and seal machine 20) at its side edges at seals 55, 56, at its lower (upstream) end at a seal 58, and at its upper (downstream) end at a seal 60. However, unlike the pouches 10, 20 above, the pouch 50 includes a score line 70 on each ply 52, 54 adjacent the seal 60. In some embodiments, the score line 70 is between about 0.25 and 0.50 inches from the adjacent edge of the upper seal 60. The score line 70 originates at one of the side edges 55, 56 of the pouch 50 (and as shown in FIG. 3, in some embodiments extends completely between the side edges 55, 56 of the pouch 50). However, the score line 70 does not fully penetrate the material of the pouch 70, but instead is formed to a controlled depth D that may be dependent on the variety of film used for the pouch 50 (see FIG. 4).

The presence of the score line 70 enables a user to tear open the pouch 50 along the score line 70. In other words, the user can open the pouch 50 by tearing "left-to-right" or "right-to-left" (i.e., across the width of the pouch 50) below the upper seal 60. This action produces a controlled, predictable tear along the score line 70, which can allow users to achieve a cleaner opening, to control the opening, and to enjoy full and easy access to the product inside. This contrasts greatly with the uncontrolled "from-the-top" tearing action previously associated some pouch packaging, particularly polyethylene pouch packaging.

The technique may be employed on any polyethylene film (or other film) suitable for pouch packing, including both monolayer and multilayer films, as well as other monolayer and multilayer films. It may also be employed with films (including polyethylene films) that include a barrier layer (which is typically on the inside of the pouch, and which may comprise a material such as ethylene vinyl alcohol (EVOH)) that may be included for freshness, protection against inadvertent tearing, and the like. For multi-layer polyethylene and other films that include a barrier layer, typically the depth of the score line 70 is controlled so that the score line 70 does not penetrate one or more of the inner layers. Typically the depth D of the score line 70 is between about 0.25 and 1 mils, and the width W is between about 0.1 and 0.25 mils. In some embodiments, the depth D of the score line 120 may be between about 10 and 60 percent of the thickness T of the material.

Also, although the score line 120 is shown herein as an unbroken line, in some embodiments the score line 120 may be a dotted line, broken line, or the like.

In particular, the technique may be employed with machine direction-oriented (MDO) films, in which the film is stretched in the machine direction after its formation to stretch and orient the film. (For a vertical seal, fill and form machine, the machine direction of an MDO film coincides with the machine direction of the machine, i.e., vertical). Formation of the score line 70 in the cross-machine direction on a pouch 50 formed of an MDO polyethylene film can provide a particularly effective arrangement for easy opening of the pouch 50.

Exemplary materials and depths that have been shown to benefit from laser scoring are listed in Table 1 below.

TABLE 1

| Material | Score Depth (mil) |
|---|---|
| 80 gauge MDO/1.25 mil Polyethylene | 0.6-0.75 |
| 80 gauge MDO/2 mil LLD Polyethylene | 0.6-0.75 |
| 90 gauge MDO/2.5 mil EVOH-PE | 0.75-0.9 |
| 80 gauge MDO/3.25 mil EVOH-PE | 0.75-1 |

Figure 5:
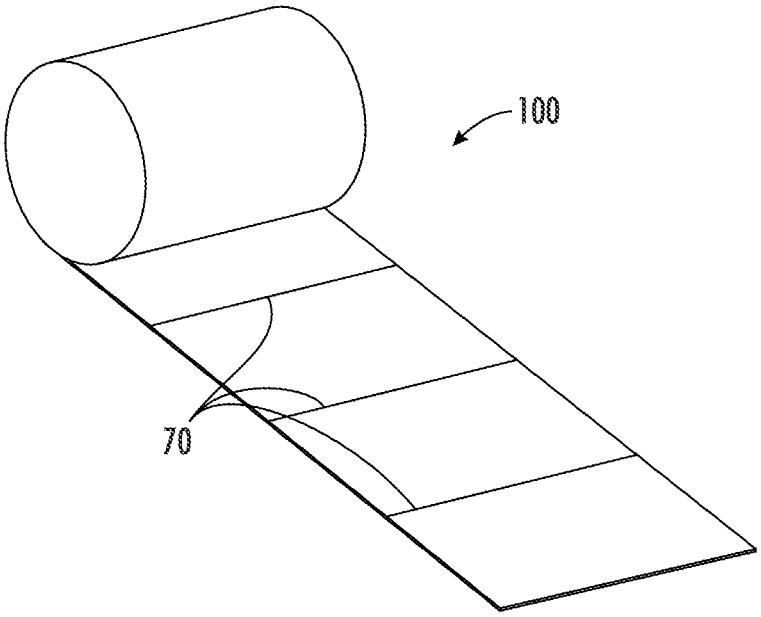
FIG. 5 is a schematic perspective view of a roll of film with score lines that can be used to form the pouch of FIG. 3.

FIG. 5 illustrates a roll 100 of film for forming the pouch 50. The roll 100 comprises polyethylene film 102 similar to that described in connection with the machines 10, 20 above, but the film includes a series of score lines 70 that are formed into the film 102 and that extend the width of the film 102. The score lines 70, which may be formed via a laser scoring device, are typically formed as the roll 100 is created (e.g., during the cutting of the film 102 into a desired narrow width from a wider roll). The regular spacing of the score lines 70 corresponds to the distance between adjacent pouches 50 during manufacturing. The depth, width, etc. of the score lines 70 in the film 102 is similar to that described above with respect to the pouch 50.

Figure 6:
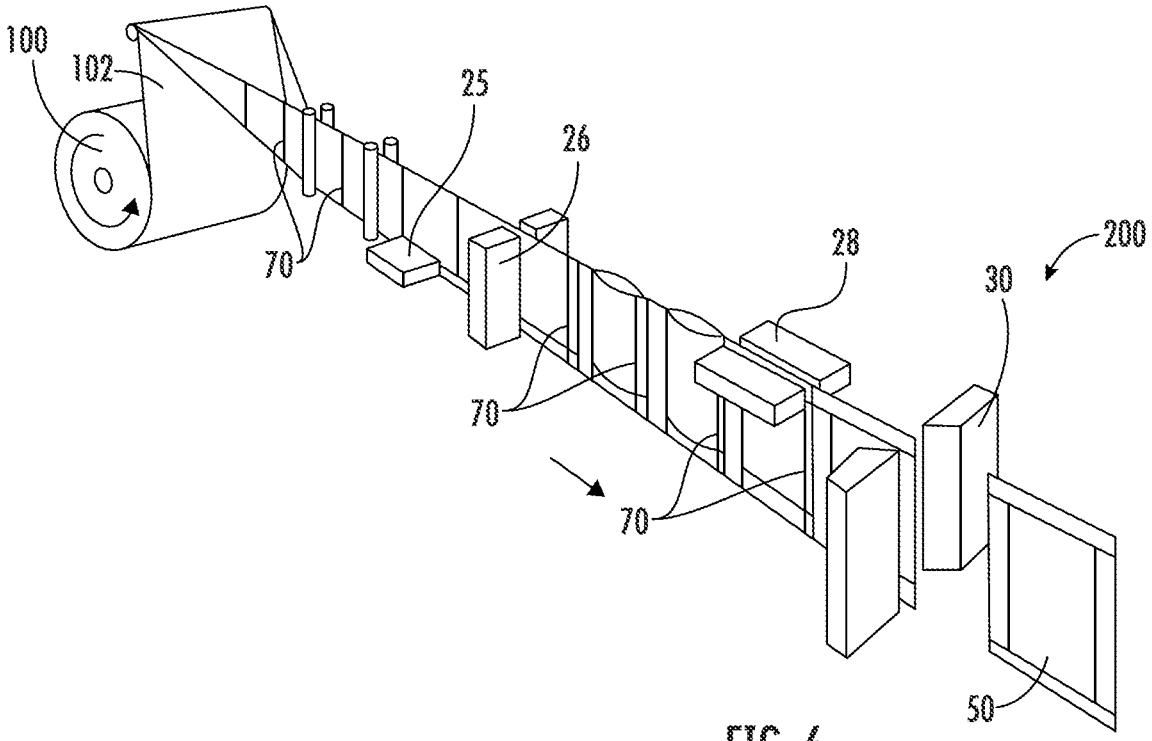
FIG. 6 is a schematic diagram of a horizontal form, fill and seal machine using the roll of FIG. 5 to form pouches of FIG. 3 according to embodiments of the invention.

Referring now to FIG. 6, the roll 100 with its film 102 can be used in a horizontal form, fill and seal machine 200 similar to that described above. As the machine 200 forms pouches 50 from the film 102 in the manner described above, each of the finished pouches 50 has a score line 70 in the desired location on each ply (i.e., on each side of the pouch 50). If an MDO polyethylene film is employed, the machine direction of the film 102 coincides with the machine direction of the horizontal form, fill and seal machine—i.e., both are horizontal. The depth and width of the score lines 70 remain as described above.

Figure 7:
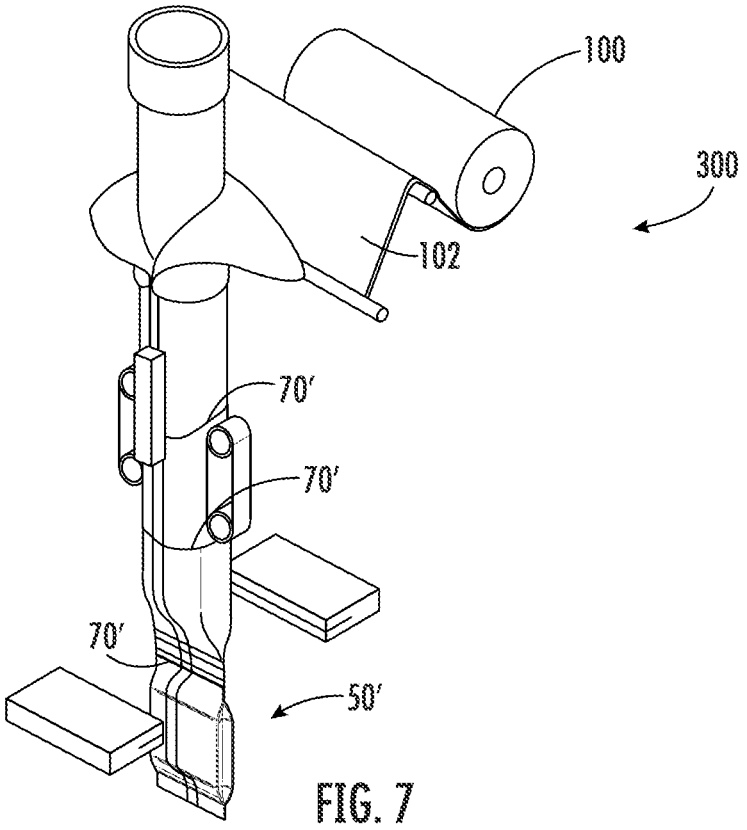
FIG. 7 is a schematic diagram of a vertical form, fill and seal machine to form pouches with score lines according to embodiments of the invention.
Figure 8:
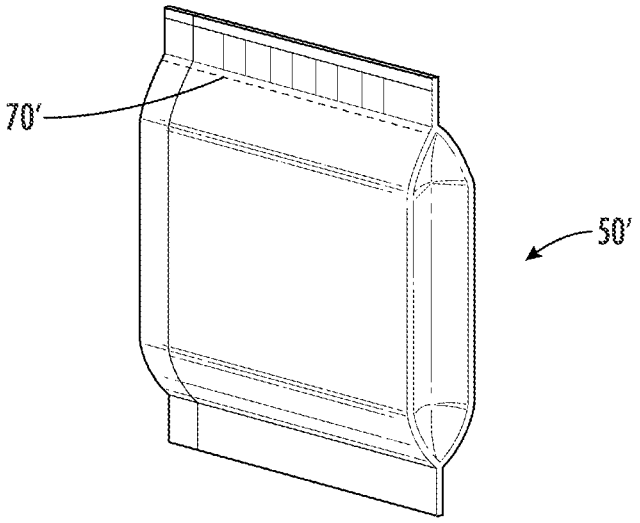
FIG. 8 is a perspective view of a pouch with a score line according to alternative embodiments of the invention.

FIG. 7 illustrates the use of the roll 100 with score lines 70 in the film 102 with a vertical form, fill and seal machine 300 that is similar to that shown in FIG. 1. Again, like the machine 100, the machine 200 uses the film 102 of the roll 100 to form pouches 50' with score lines 70'. FIG. 8 illustrates an exemplary pouch 50'.

As discussed above, inclusion of a score line in a pouch formed of polyethylene or other polymeric films can provide a pouch with predictable tearing, which can improve the user's experience and enjoyment of the product. Also, when the pouch is formed of polyethylene, the manufacturer of the pouch can provide packaging that is fully recyclable and/or compostable. Other exemplary materials include monolayer or multi-layer structures, including compostable and recyclable films.

As noted above, in some instances the score lines 70 of the pouches 50, 50' may extend the full width of the pouch (i.e., the score lines 70 reach the edges on both sides of the pouch 50), such that the top portion of the pouch 50 is completely removed when the pouch 50 is opened. If the contents of the pouch 50 are completely emptied when the pouch 50 is opened, then it may be convenient to place both the torn top of the pouch 50 and the remainder of the pouch 50 in a recycling bin immediately after the pouch 50 is opened and emptied. However, in some instances the pouch 50 may contain material (e.g., pet food) that is not used all at once, but instead may be saved for a latter occasion; thus, the contents of the pouch 50 are not emptied, and the user must either dispose of the torn top of the pouch 50 at that time or save the torn top for recycling with the remainder of the pouch 50 at a later time. In many instances, the user will simply throw the torn top of the pouch 50 into a nearby trash receptacle, thereby negating some of the sustainability achieved by using a recyclable material such as polyethylene.

Figure 9:
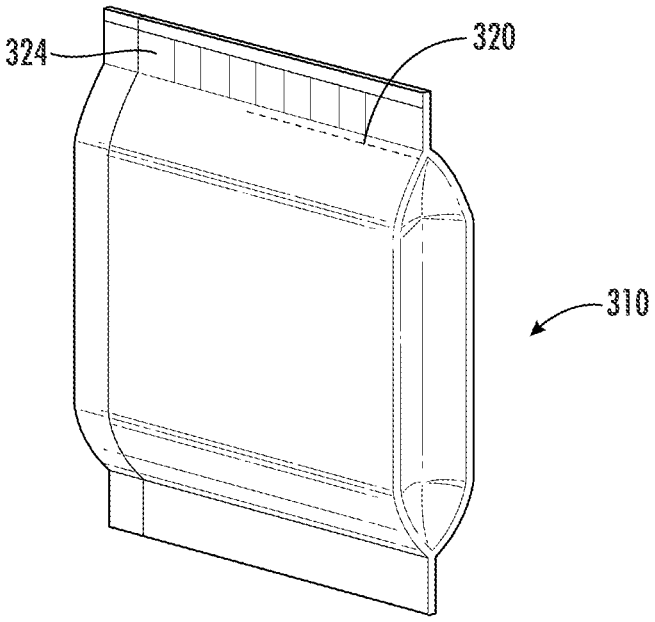
FIG. 9 is a perspective view of a pouch with a partial score line according to embodiment of the invention.
Figure 10:
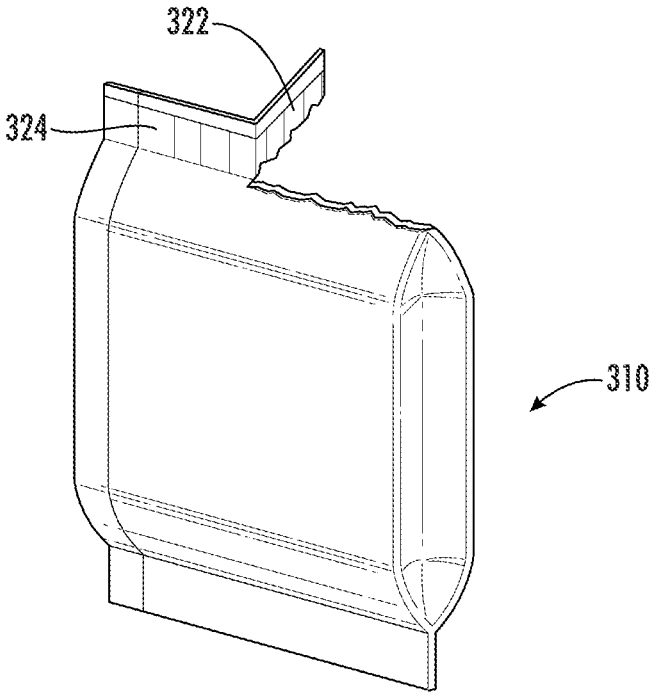
FIG. 10 is a perspective view of the pouch of FIG. 9 illustrating that the torn top of the pouch remains with the pouch after opening.

FIGS. 9 and 10 illustrates a pouch 310 that can address this issue. As can be seen in FIG. 9, the pouch 310 includes a score line 320 that does not extend the full width of the pouch 310. Instead, the score line 320 extends from one side edge of the pouch 310 to enable the pouch 310 to be opened, but stops short of the opposite side edge, such that the user cannot easily tear off the entire top of the pouch 310. As a result, the torn top 322 remains with the pouch 310 (see FIG. 10).

Because the top 322 remains with the pouch 310, the user does not need to either find a recycling bin immediately or save the top to recycle with the remainder of the pouch 310 once it is empty. Instead, the torn top 322 remains with the pouch 310 until it is empty, at which time the entire pouch 310 (including the torn top 322) can be recycled.

In some embodiments, the pouch 310 may include a feature that assists with keeping the torn top 322 out of the way until the pouch 310 is empty. As one example, the pouch 310 may include an adhesive dot, patch or the like that is positioned such that the torn top 322 can be folded out of the way. As another example, the upper seal 324 of the pouch 310 may include a small slit that can be employed to engage one of the side edges of the pouch 310 to keep the top out of the way. Other variations may also be possible.

Further, retention of the torn top 322 with the remainder of the pouch 310 may provide additional features for the pouch. As one example, the torn top 322 may result in an opening that is a particular desired size for the pouch (e.g., the opening is sized to control pouring or to prevent spillage). As another example, the torn top 322 may act as a carrying handle. Other possibilities may be apparent to those of skill in this art.

Figure 11:
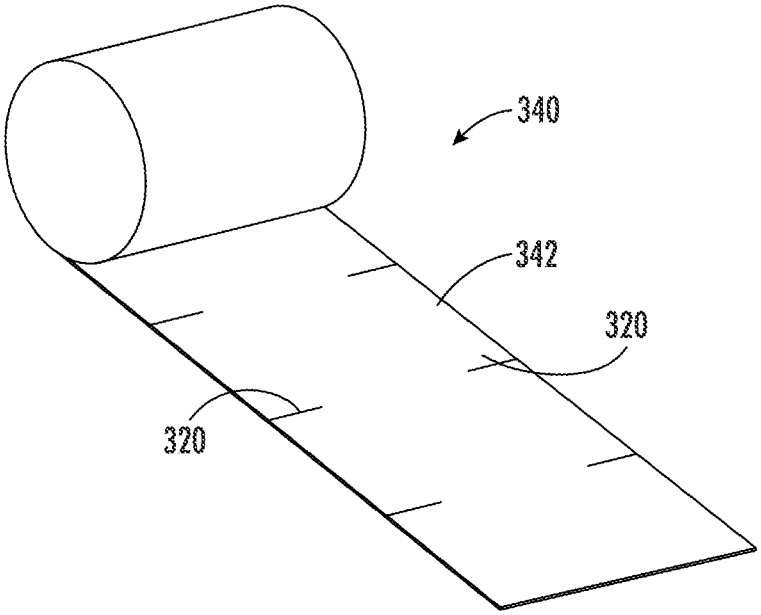
FIG. 11 is a perspective view of a roll of film with score lines that can be employed to form the pouch of FIG. 9.

FIG. 11 illustrates a roll 340 that can be used to form the pouch 310. As shown in FIG. 11, the roll 310 includes film 342 with discontinuous score lines 320; each score line 320 extends from the edge of the film 342 toward the center to the film 342, but stops before meeting its corresponding score line 320. As such, when the film 342 is folded (e.g., with a horizontal or vertical form, fill and seal machine), the corresponding score lines 320 will appear in alignment on opposite plies of the pouch 310, but will not extend the full width of the pouch 310, thereby enabling the torn top 322 to remain with the pouch 310 after being torn.

Figure 12:
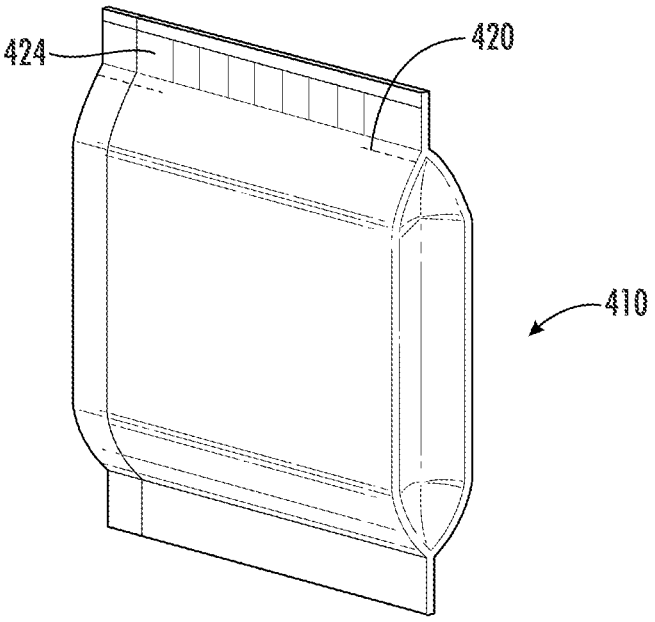
FIG. 12 is a perspective view of a pouch with two partial score lines according to alternative embodiments of the invention.
Figure 13:
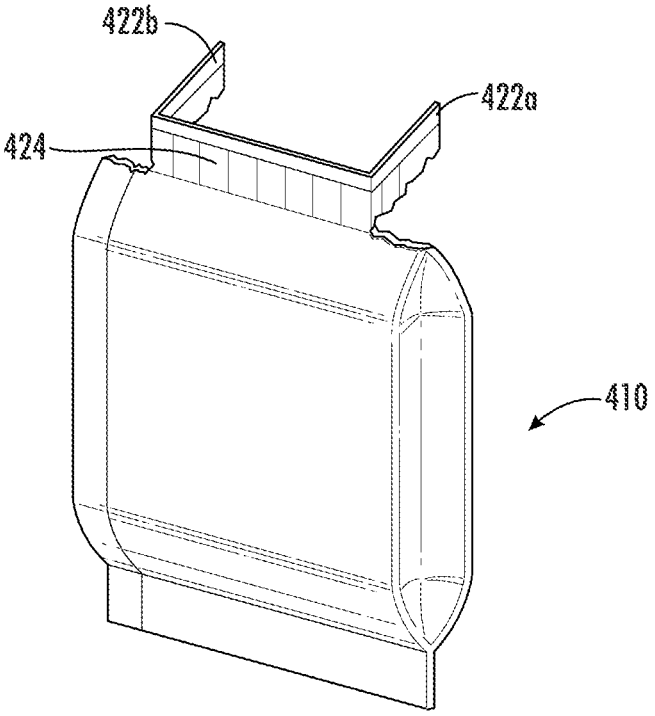
FIG. 13 is a perspective view of the pouch of FIG. 12 illustrating that the torn top of the package (which can be torn from either side) remains with the package.

FIGS. 12 and 13 illustrate another pouch, designated broadly at 410. The pouch 410 is similar to the pouch 310 shown in FIGS. 9 and 10 with the exception that the pouch 410 includes two score lines 420 (one extending from each side edge of the pouch 410) below the upper seal 424. Thus, a user can tear the pouch at the score lines 420 to produce one or two torn tops 422*a*, 422*b* (see FIG. 13).

Some embodiments of the present invention are exemplarily described above in combination with the accompanying drawings. Those of ordinary skill in the art to which the present invention belongs should understand that specific structures shown in the above embodiments are merely exemplary, rather than limiting. Moreover, those of ordinary skill in the art to which the present invention belongs can combine a variety of technical features shown above according to a variety of possible manners to constitute new technical solutions or make other modifications, and these new technical solutions are encompassed within the scope of the present invention.

What is claimed is:

1. A sealed package, comprising:

a first ply and a second ply opposed to the first ply, each of the first and second plies with first and second edges, wherein the first edges of the first and second plies have overlying sections that form a first seal, and wherein the second edges of the first and second plies have overlying sections that form a second seal;

wherein the first and second plies comprise machine direction oriented (MDO) polyethylene film; and wherein a score line is present adjacent the second seal, the score line only partially penetrating the first ply and extending less than a full width of the first ply, the score line being oriented in a cross-machine direction relative to the MDO polyethylene.

2. The sealed package defined in claim 1, wherein the score line has a depth of between about 0.25 and 0.5 mils.

3. The sealed package defined in claim 1, wherein the score line has a depth that is between about 10 and 60 percent of a thickness of the first ply.

4. The sealed package defined in claim 1, wherein the score line is a first score line, and further comprising a second score line, the second score line only partially penetrating the first ply and extending less than a full width of the first ply, the first and second score lines extending from opposite side edges of the package.

5. The sealed package defined in claim 1, wherein the polymeric material is a recyclable material or a compostable material.

* * * * *